US007669567B2

(12) United States Patent
Sudou

(10) Patent No.: US 7,669,567 B2
(45) Date of Patent: Mar. 2, 2010

(54) VALVE TIMING ADJUSTING DEVICE

(75) Inventor: Akiyuki Sudou, Takahama (JP)

(73) Assignee: DENSO Corporation, Kariya (JP)

( * ) Notice: Subject to any disclaimer, the term of this patent is extended or adjusted under 35 U.S.C. 154(b) by 402 days.

(21) Appl. No.: 11/896,535

(22) Filed: Sep. 4, 2007

(65) Prior Publication Data

US 2008/0083383 A1 Apr. 10, 2008

(30) Foreign Application Priority Data

Oct. 6, 2006 (JP) ..... 2006-275514

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31

See application file for complete search history.

(56) References Cited

U.S. PATENT DOCUMENTS 5,680,837 A * 10/1997 Pierik ..... 123/90.17

FOREIGN PATENT DOCUMENTS

DE 41 10 195 2/2000

OTHER PUBLICATIONS

U.S. Appl. No. 11/705,516, filed Feb. 13, 2007, Inventor: Sugiura et al.

* cited by examiner

*Primary Examiner*—Zelalem Eshete
(74) *Attorney, Agent, or Firm*—Nixon & Vanderhye, PC

(57) ABSTRACT

In a valve timing adjusting device, a support section of a planetary carrier supporting a planetary rotator to enable sun-and-planet motion is located on an inner peripheral side of a first center, which is a tooth contact center between a first gear section of the first rotator and a third gear section of the planetary rotator, and is separate from an inner peripheral side of a second center, which is a tooth contact center between a second gear section of the second rotator and a fourth gear section of the planetary rotator. First moment generated in the planetary rotator by a radial load applied to the third gear section by the first gear section is larger than second moment generated in the planetary rotator by a radial load applied to the fourth gear section by the second gear section.

12 Claims, 11 Drawing Sheets

VALVE TIMING ADJUSTING DEVICE

CROSS REFERENCE TO RELATED APPLICATION

This application is based on and incorporates herein by reference Japanese Patent Application No. 2006-275514 filed on Oct. 6, 2006.

BACKGROUND OF THE INVENTION

1. Field of the Invention

The present invention relates to a valve timing adjusting device for an internal combustion engine.

2. Description of Related Art

A known valve timing adjusting device adjusts valve timing by changing a relative phase between two rotators, which rotate in conjunction with a crankshaft and a camshaft, with the use of a planetary mechanism (for example, as described in German Patent Gazette No. 4110195C2). In this kind of valve timing adjusting device, gear sections provided on the rotators respectively interlocked with the crankshaft and the camshaft are geared individually with two gear sections provided on a planetary rotator. Thus, a large reduction gear ratio can be obtained by a compact design. Thus, a suitable valve timing adjusting device attached to the engine is provided.

In the valve timing adjusting device of the above-described kind, a planetary carrier supporting the planetary rotator receives a radial load, which is generated by the engagement between the gear sections and is applied to the planetary rotator. A mode of receiving the radial load differs depending on the numbers of teeth, diameters and the like of the gear sections. The inventor of the present invention discovered the problem that the planetary rotator is inclined from a proper axial direction depending on the mode of receiving the load.

In a mode shown in FIG. 11, a planetary carrier 1004 supports a planetary rotator 1000 on an inner peripheral side of a tooth contact center c1 as a longitudinal center of each of geared portions of a gear section 1001 of the planetary rotator 1000 and a gear section 1003 of an interlocked rotator 1002 of a camshaft. The planetary rotator 1000 is separate from and is not supported by the planetary carrier 1004 on an inner peripheral side of a tooth contact center c2 as a longitudinal center of each of geared portions of the other gear section 1005 of the planetary rotator 1000 and a gear section 1007 of an interlocked rotator 1006 of the crankshaft. In such the mode, if moment f1·a1 produced by the radial load f1 between the gear sections 1001, 1003 becomes smaller than moment f2·a2 produced by the radial load f2 between the gear sections 1005, 1007, the planetary rotator 1000 rotates in a moment direction d of the latter moment F2·a2 and inclines.

Such the inclination of the planetary rotator can generate a thrust load between the gear sections engaged with each other and cause a fall in durability. Therefore, such the inclination is not desirable.

SUMMARY OF THE INVENTION

It is an object of the present invention to provide a valve timing adjusting device securing durability.

According to an aspect of the present invention, a valve timing adjusting device of an internal combustion engine adjusts valve timing of at least one of an intake valve and an exhaust valve, which are opened and closed by a camshaft through torque transmission from a crankshaft. The valve timing adjusting device has a first rotator that has a first gear section and that rotates with the camshaft in an interlocked manner, a second rotator that has a second gear section and that rotates with the crankshaft in an interlocked manner, a planetary rotator that has a third gear section and a fourth gear section and changes a relative phase between the first rotator and the second rotator through sun-and-planet motion of the third gear section and the fourth gear section performed while the third gear section and the fourth gear section are geared with the first gear section and the second gear section respectively, and a planetary carrier that has a support section for supporting the planetary rotator such that the sun-and-planet motion can be performed. The support section is located on an inner peripheral side of a first center, which is a tooth contact center as a longitudinal center of each of geared portions of the first gear section and the third gear section, and is separate from an inner peripheral side of a second center, which is a tooth contact center as a longitudinal center of each of geared portions of the second gear section and the fourth gear section. First moment generated in the planetary rotator by a radial load applied to the third gear section by the first gear section is larger than second moment generated in the planetary rotator by a radial load applied to the fourth gear section by the second gear section.

Thus, the first moment generated in the planetary rotator by the radial load applied to the third gear section by the first gear section is larger than the second moment generated in the planetary rotator by the radial load applied to the fourth gear section by the second gear section. Therefore, the planetary rotator tends to rotate in the first moment direction and to incline from a proper axial direction. The support section of the planetary carrier supporting the planetary rotator is located on the inner peripheral side of the first center as the tooth contact center between the first gear section and the third gear section. However, the support section is separate from the inner peripheral side of the second center as the tooth contact center between the second gear section and the fourth gear section. Therefore, the inclination of the planetary rotator can be inhibited by the reaction force applied by the support section. When the planetary rotator inclines due to the first moment larger than the second moment, there is a possibility that a thrust load occurs between the first gear section and the third gear section or between the second gear section and the fourth gear section and deteriorates the durability. However, the durability can be secured by inhibiting the inclination of the planetary rotator.

The support section is a portion of the planetary carrier that actually contacts the planetary rotator to support the planetary rotator. The tooth contact center is a longitudinal center of each of the geared portions of the gear sections, at which the teeth of the gear sections contact each other. The radial load is a load component acting radially on each of the gear sections geared with each other.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
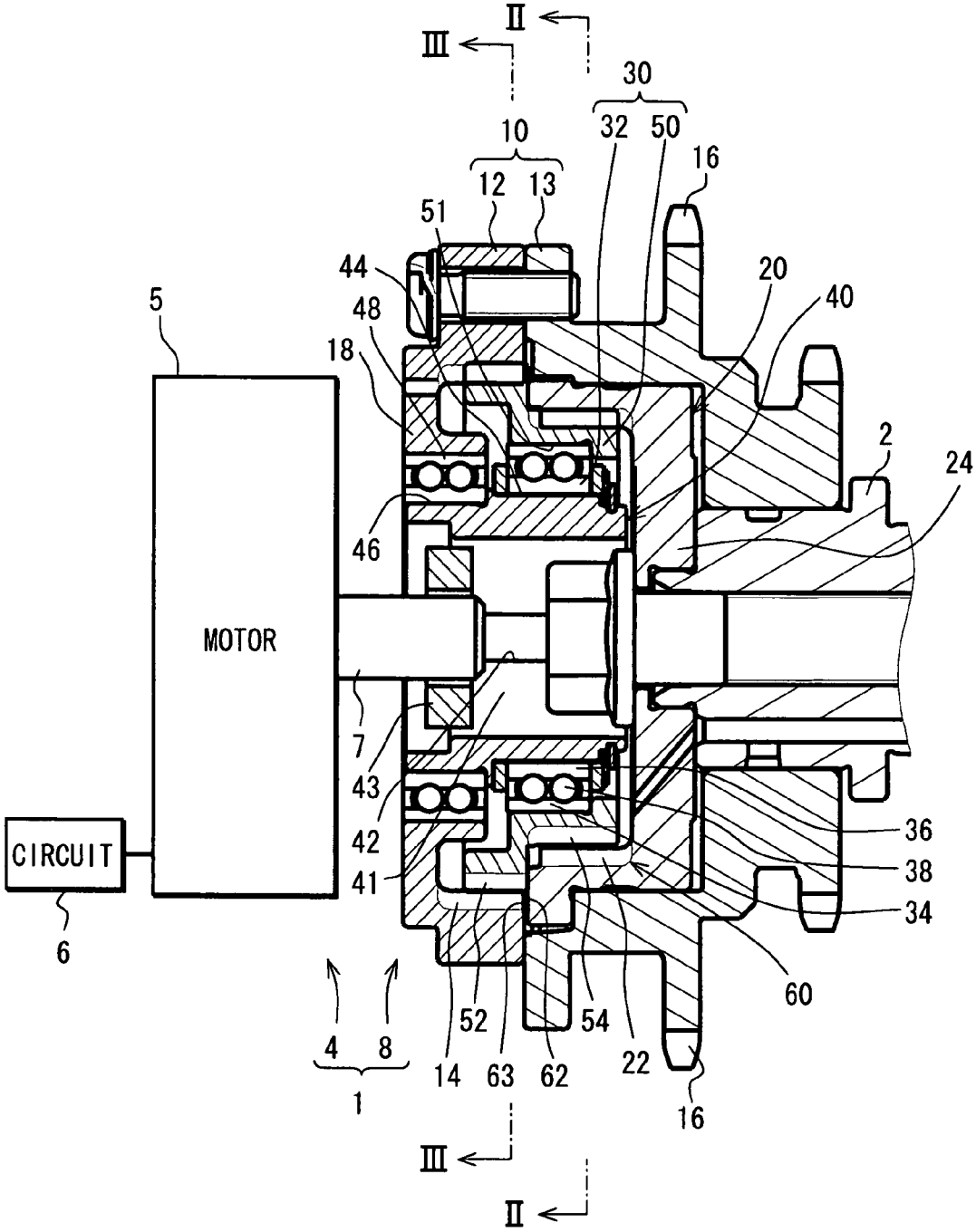
FIG. 1 is a longitudinal sectional view showing a valve timing adjusting device according to a first embodiment of the present invention.

Referring to FIG. 1, a valve timing adjusting device 1 according to a first embodiment of the present invention is illustrated. The valve timing adjusting device 1 is mounted in a vehicle and is provided in a transmission system that transmits engine torque from a crankshaft (not shown) of an internal combustion engine to a camshaft 2. The valve timing adjusting device 1 is provided by combining a torque generating system 4, a phase adjusting mechanism 8 and the like. The valve timing adjusting device 1 serially realizes valve timing suitable for the engine by adjusting a relative phase (engine phase) of the camshaft 2 with respect to the crankshaft. In the present embodiment, the camshaft 2 opens and closes an intake valve (not shown) of the engine. The valve timing adjusting device 1 adjusts the valve timing of the intake valve.

First, the torque generating system 4 will be explained. The torque generating system 4 has an electric motor 5 and an energization control circuit 6. For example, the electric motor 5 is a brushless motor. The electric motor 5 generates torque to be given to a rotary shaft 7 when energized. The energization control circuit 6 consists of a microcomputer and the like and is arranged outside and/or inside the electric motor 5. The energization control circuit 6 is electrically connected with the electric motor 5 and controls the energization of the electric motor 5 according to an operation condition of the engine. In response to the controlled energization, the electric motor 5 holds or changes the torque applied to the rotary shaft 7.

Next, the phase adjusting mechanism 8 will be explained. The phase adjusting mechanism 8 has a driving rotator 10, a driven rotator 20, a planetary carrier 40, and a planetary rotator 30. The driving rotator 10 is made by coaxially screwing a gear member 12 and a sprocket 13, each of which is formed in the shape of a cylinder with a bottom. A peripheral wall section of the gear member 12 provides a driving internal gear section 14, an addendum circle of which resides radially inside a root circle thereof. Multiple gear teeth 16 projecting radially outward are formed on the sprocket 13. The sprocket 13 is linked with the crankshaft by a timing chain (not shown) disposed around in meshed engagement with the gear teeth 16 and multiple gear teeth of the crankshaft. Therefore, when the engine torque outputted from the crankshaft is inputted into the sprocket 13 through the timing chain, the driving rotator 10 is interlocked with the crankshaft and rotates while maintaining a relative phase with respect to the crankshaft. At this time, the direction of the rotation of the driving rotator 10 coincides with the counterclockwise direction in FIGS. 2 and 3.

Figure 2:
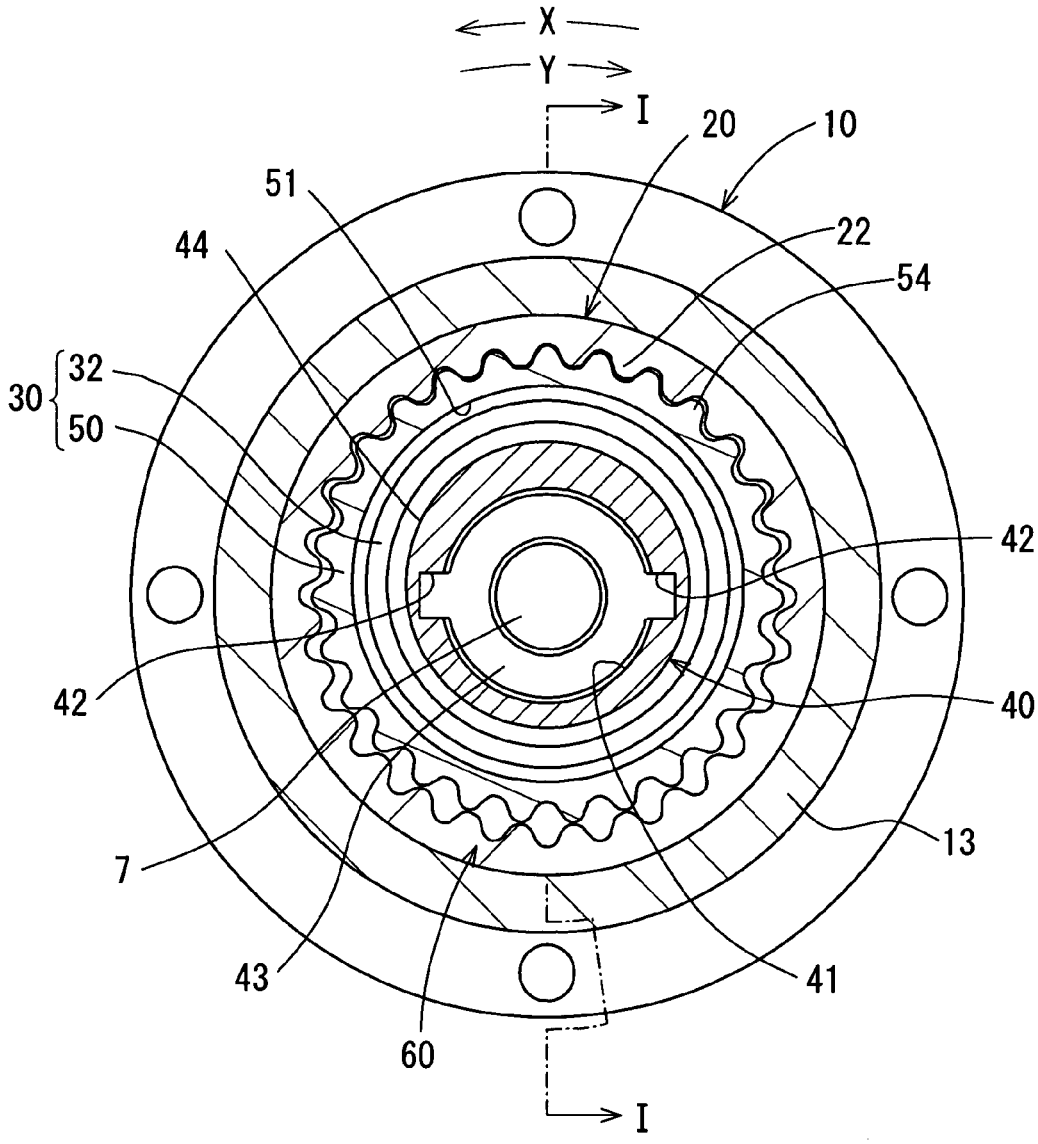
FIG. 2 is a sectional view showing the valve timing adjusting device of FIG. 1 taken along the line II-II.

As shown in FIGS. 1 and 2, the driven rotator 20 formed in the shape of a cylinder with a bottom is arranged radially inside the sprocket 13 coaxially. A peripheral wall section of the driven rotator 20 provides a driven internal gear section 22. An addendum circle of the driven internal gear section 22 resides radially inside a root circle thereof. The driven internal gear section 22 is fitted to an inner peripheral side of the sprocket 13 such that the driven internal gear section 22 is deviated from the driving internal gear section 14 in the axial direction.

As shown in FIG. 1, the bottom wall portion of the driven rotator 20 defines a linked part 24, which is coaxially linked to the camshaft 2 through bolt fixation. Because of the linkage between the linked part 24 and the camshaft 2, the driven rotator 20 can rotate with the camshaft 2 while maintaining the relative phase with respect to the camshaft 2 and can perform relative rotation with respect to the driving rotator 10. The direction of relative rotation for the driven rotator 20 to advance with respect to the driving rotator 10 is the direction X in FIGS. 2 and 3. The direction of relative rotation for the driven rotator 20 to retard with respect to the driving rotator 10 is the direction Y in FIGS. 2 and 3.

Figure 3:
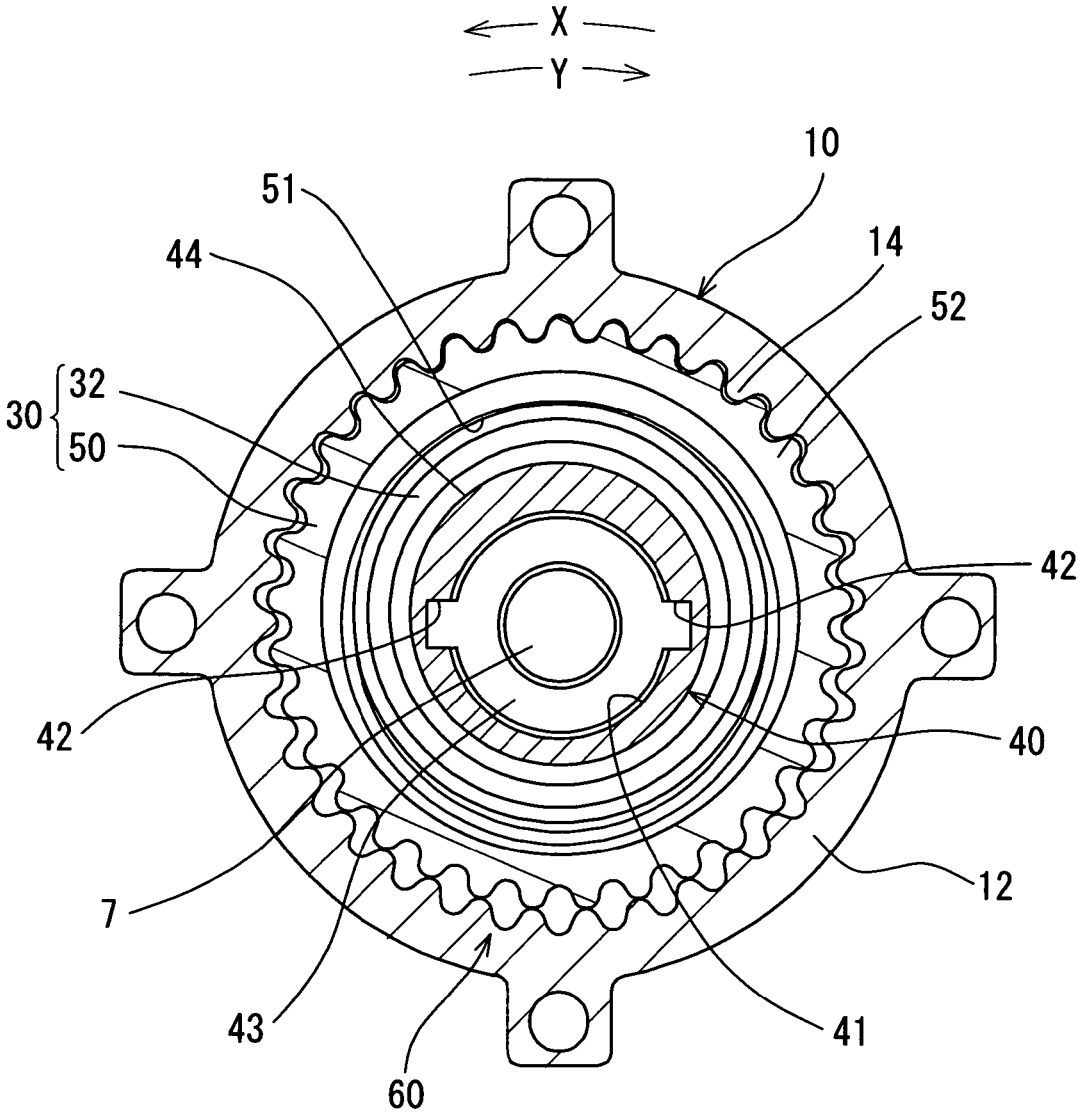
FIG. 3 is a sectional view showing the valve timing adjusting device of FIG. 1 taken along the line III-III.

The planetary carrier 40 is formed in a cylindrical shape as shown in FIGS. 1 to 3. An inner periphery of the planetary carrier 40 provides an input section 41, to which the torque is inputted from the rotary shaft 7 of the torque generating system 4. The input section 41 is coaxial with the rotators 10, 20 and the rotary shaft 7. Multiple grooves 42 are opened in the input section 41. The planetary carrier 40 is linked with the rotary shaft 7 through a joint 43 fitted to the grooves 42. Because of the linkage, the planetary carrier 40 can rotate together with the rotary shaft 7 and can perform relative rotation with respect to the rotators 10, 20.

An end portion of the outer periphery of the planetary carrier 40 defines an eccentric portion 44 eccentric with respect to the gear sections 14, 22. The other end portion of the outer periphery of the planetary carrier 40 defines a concentric portion 46 concentric with the gear member 12. An annular bottom wall portion 18 of the gear member 12 is fitted to an outer periphery of the concentric portion 46 through a bearing 48.

The planetary rotator 30 is made by combining a bearing 32 and a planetary gear 50 concentrically. The bearing 32 is a radial bearing made by holding ball-shaped rolling members 38 between an outer ring 34 and an inner ring 36. In the present embodiment, the outer ring 34 of the bearing 32 is press-fitted and fixed to an inner peripheral side of a center hole 51 of the planetary gear 50. The inner ring 36 of the bearing 32 is fitted to the outer periphery of the eccentric portion 44 of the planetary carrier 40. Thus, the planetary rotator 30 is supported by the planetary carrier 40 while a small radial gap is formed between the eccentric portion 44 and the inner ring 36.

The planetary gear 50 is formed in the shape of a cylinder with a step and is arranged concentrically with the eccentric portion 44. That is, the planetary gear 50 is arranged to be eccentric with respect to the gear sections 14, 22. A large diameter portion and a small diameter portion of the planetary gear 50 respectively define a driving external gear section 52 and a driven external gear section 54 in a single body. The driving external gear section 52 and the driven external gear section 54 have addendum circles radially outside root circles respectively. The driving external gear section 52 is arranged radially inside the driving internal gear section 14 and is geared with the gear section 14. The driven external gear section 54 is located such that the driven external gear section 54 is deviated from the driving external gear section 52 in the axial direction. The driven external gear section 54 is arranged radially inside the driven internal gear section 22 and is geared with the gear section 22. Under such the geared state, the planetary gear 50 can realize sun-and-planet motion to revolve in the direction of rotation of the eccentric portion 44 while rotating around the eccentric center of the eccentric portion 44.

The above-described structure provides a planetary mechanism section 60 of a differential gear type in the phase adjusting mechanism 8 for transmitting rotational motion of the planetary carrier 40 to the camshaft 2 while reducing rotation speed. A reduction gear ratio N of the planetary mechanism section 60 is expressed by a following expression (1) with the numbers of the teeth Z1, Z2, Z3, Z4 of the respective gear sections 22, 14, 54, 52. In the present embodiment, setting is made such that the number of the teeth increases in the order of Z3, Z1, Z4, and Z2 (Z3<Z1<Z4<Z2).

$$N=(Z1/Z3\sim Z4/Z2)/(Z1/Z3\cdot Z4/Z2-1) \quad (1)$$

The phase adjusting mechanism 8 having such the planetary mechanism section 60 adjusts the engine phase in accordance with the torque inputted from the torque generating system 4 and average torque Ta of fluctuation torque transmitted from the camshaft 2. The fluctuation torque is torque transmitted to the phase adjusting mechanism 8 because of operation of the engine. In the present embodiment, the driven rotator 20 is biased by the average torque Ta of the fluctuation torque in the retardation direction Y with respect to the driving rotator 10.

For example, as an operation of the phase adjusting mechanism 8, when the planetary carrier 40 does not perform the relative rotation with respect to the driving rotator 10, for example, when the input torque from the torque generating system 4 is maintained, the planetary gear 50 of the planetary rotator 30 rotates together with the rotators 10, 20 while maintaining the geared positions with the gear sections 14, 22. Therefore, the engine phase does not change, and as a result, the valve timing is kept constant.

When the planetary carrier 40 performs the relative rotation in the direction X with respect to the driving rotator 10, for example, because the input torque from the torque generating system 4 increases in the direction X, the planetary gear 50 of the planetary rotator 30 performs the sun-and-planet motion while changing the geared positions with the gear sections 14, 22. Accordingly, the driven rotator 20 performs the relative rotation in the direction X with respect to the driving rotator 10. Thus, the engine phase changes to the advanced side and the valve timing advances as a result.

When the planetary carrier 40 performs the relative rotation in the direction Y with respect to the driving rotator 10, for example, when the input torque from the torque generating system 4 increases in the direction Y, the planetary gear 50 of the planetary rotator 30 performs the sun-and-planet motion while changing the geared positions with the gear sections 14, 22. Accordingly, the driven rotator 20 performs the relative rotation in the direction Y with respect to the driving rotator 10. Therefore, the engine phase changes to the retarded side and the valve timing retards as a result.

Next, a substantial portion of the first embodiment will be explained in detail with reference to FIGS. 1 and 4. As shown in FIG. 1, in the first embodiment, an axial end face 63 of the driven internal gear section 22 on the driving internal gear section 14 side contacts an axial end face 62 of the driving external gear section 52 on the driven external gear section 54 side. A small thrust gap is formed between the end faces 62, 63, so relative rotation between the planetary gear 50 and the driven rotator 20 is enabled.

Figure 4:
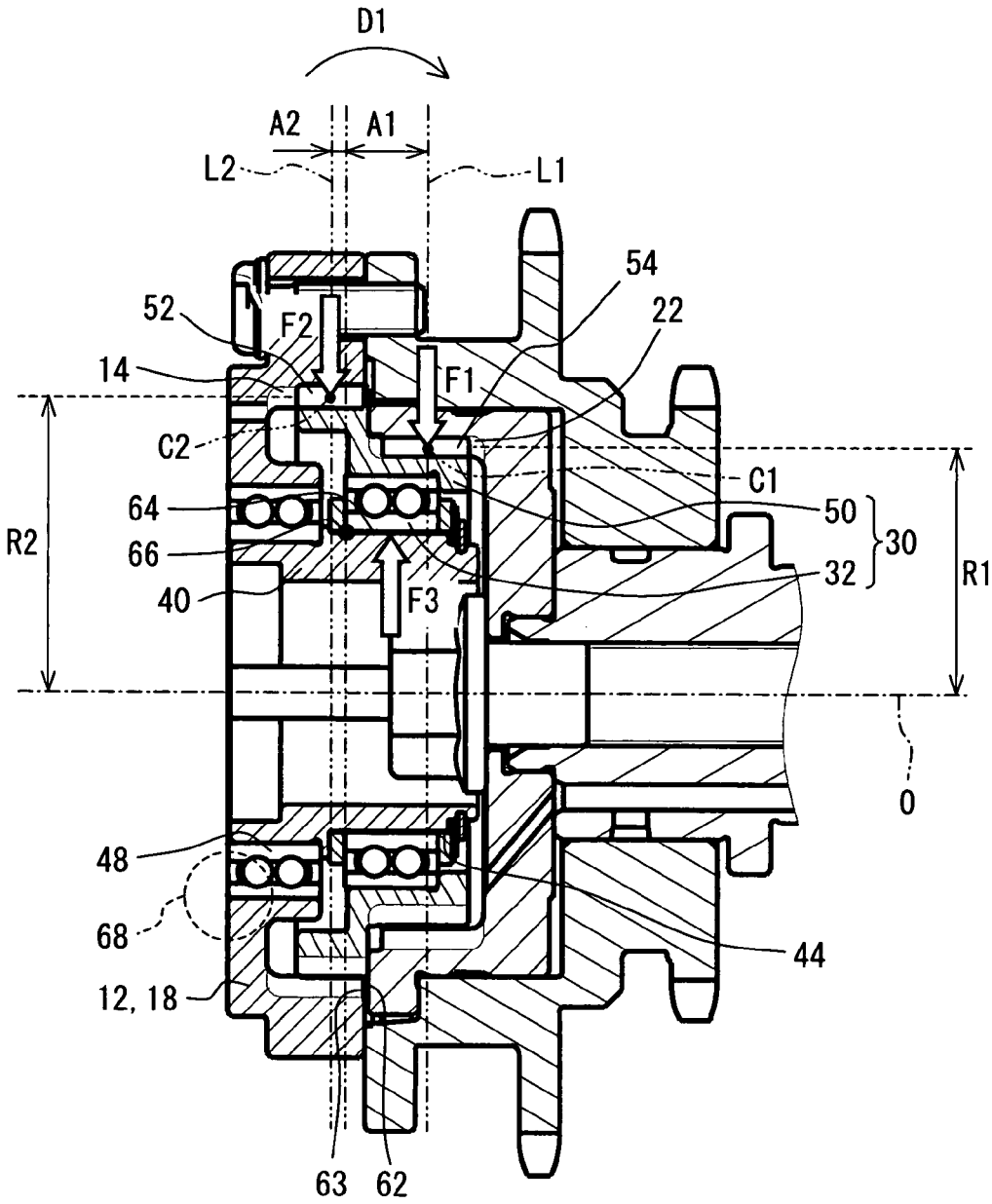
FIG. 4 is a longitudinal sectional view showing a substantial portion of the valve timing adjusting device according to the first embodiment.

As shown in FIG. 4, in the first embodiment, a support section 64 provided by a part of the eccentric portion 44 of the planetary carrier 40 supports the planetary rotator 30 on a projection line L1, which is made by radially projecting a tooth contact center C1 between the driven internal gear section 22 and the driven external gear section 54. The tooth contact center C1 is a longitudinal or geometric center of each of the geared portions of the driven internal gear section 22 and the driven external gear section 54. On a projection line L2, which is radially projected from a tooth contact center C2 between the driving internal gear section 14 and the driving external gear section 52, the planetary rotator 30 is separate from and is not supported by the planetary carrier 40. The tooth contact center C2 is a longitudinal or geometric center of each of the geared portions of the driving internal gear section 14 and the driving external gear section 52. The support section 64 is located on the projection line L1 side of the projection line L2. Thus, the first embodiment correctly realizes the structure in which the support section 64 of the planetary carrier 40 supporting the planetary rotator 30 is located radially inside the tooth contact center C1 but deviated from the inner peripheral side of the tooth contact center C2. An end 66 of the support section 64 on the driving external gear section 52 side may be located radially inside at least one of the gear sections 52, 14 or may be deviated from the range radially inside the gear sections 52, 14 unless the end 66 reaches a point radially inside the tooth contact center C2.

In the support structure having such the features, as shown in FIG. 4, a radial load F1 generated by the engagement between the gear sections 22, 54 acts on the planetary rotator 30 along the projection line L1 of the tooth contact center C1. As a result, the radial load F1 causes first moment F1·A1 around the end 66 in the planetary rotator 30. A1 is a distance in the axial direction between the end 66 of the support section 64 and the tooth contact center C1 (substantially equal to gap between end 66 and projection line L1).

A radial load F2 generated by the engagement between the gear sections 14, 52 acts on the planetary rotator 30 along the projection line L2 of the tooth contact center C2. As a result, the radial load F2 causes second moment F2·A2 around the end 66 in the planetary rotator 30. A2 is a distance in the axial direction between the end 66 of the support section 64 and the tooth contact center C2 (substantially equal to gap between end 66 and projection line L2).

The thus-produced first moment F1·A1 and the second moment F2·A2 cause the planetary rotator 30 to rotate in opposite directions mutually and cause the planetary rotator 30 to incline from a proper axial direction substantially parallel to a central axis line O of the gear sections 22, 14. The inclination of the planetary rotator 30 can arise depending on the magnitude relation of the moments. Therefore, in the present embodiment, as shown by a following expression (2), setting is made such that the first moment F1·A1 corresponding to the tooth contact center C1, radially inside which the support section 64 is located, out of the contact centers C1, C2 is greater than the second moment F2·A2.

$$F1\cdot A1>F2\cdot A2 \quad (2)$$

Because of such the setting, the planetary rotator 30 tends to incline in the direction D1 of the larger first moment F1·A1 around the proximity of the end 66 of the support section 64 of the planetary carrier 40. However, the inclination is inhibited because a reaction force F3 is applied to the planetary rotator 30 by the support section 64. If the planetary rotator 30 inclines, there is a possibility that a thrust load occurs between the gear sections 22, 54 or between the gear sections 14, 52. However, the thrust load is prevented because the inclination of the planetary rotator 30 is inhibited.

F1 and F2 in the expression (2) are expressed by following expressions (3) and (4) respectively by using the average torque Ta of the fluctuation torque transmitted from the camshaft 2, pressure angles θ1, θ2 inherent in the gear sections 54, 52, pitch radii R1, R2 inherent in the gear sections 54, 52 (shown in FIG. 4), and the reduction gear ratio N of the planetary mechanism section 60 (provided by expression (1)). Therefore, it is understood that a design satisfying a following expression (5) obtained from the expressions (2), (3), and (4) can inhibit the inclination of the planetary rotator 30. When the pressure angle θ1, θ2 of the gear sections 54, 52 are substantially the same, the value of tan θ2/tan θ1 in the expression (5) is 1, which facilitates the design for inclination inhibition. Alternatively, the pressure angles θ1, θ2 may be differentiated.

$$F1=Ta/R1\cdot\tan\theta1 \quad (3)$$

$$F2=(N-1)/N\cdot Ta/R2\cdot\tan\theta2 \quad (4)$$

$$A1>A2\cdot(N-1)/N\cdot R1/R2\cdot\tan\theta2/\tan\theta1 \quad (5)$$

In the first embodiment, the characteristic supporting mode of the planetary rotator 30 with the planetary carrier 40 and the characteristic setting of the moment corresponding to the supporting mode inhibit the inclination of the planetary rotator 30 and the generation of the thrust load between the gear sections as a result. Moreover, as shown in FIG. 4, in the first embodiment, the axial end face 63 of the driven internal gear section 22 contacts the axial end face 62 of the driving external gear section 52 of the planetary gear 50 constituting the planetary rotator 30. This structure also inhibits the inclination of the planetary rotator 30 and the generation of the thrust load as a result. Accordingly, shortening of the life of the bearing 32 fixed to the planetary gear 50 in the planetary rotator 30 due to the thrust load can be prevented. There is no need to provide a retainer of the bearing 48 in an area surrounded by a dashed line 68 in the bottom wall portion 18 of the gear member 12 shown in FIG. 4. As a result, according to the first embodiment, high durability, reduction in axial physique, reduction of cost and the like are realized at the same time.

In the first embodiment, the axial length of the support section 64 of the planetary carrier 40 is decided by the bearing 32 to be used. The geared positions of the gear sections 14, 52 can be freely set irrespective of the axial length of the support section 64 unless the tooth contact center C2 overlaps with the support section 64 in the radial direction.

Figure 5:
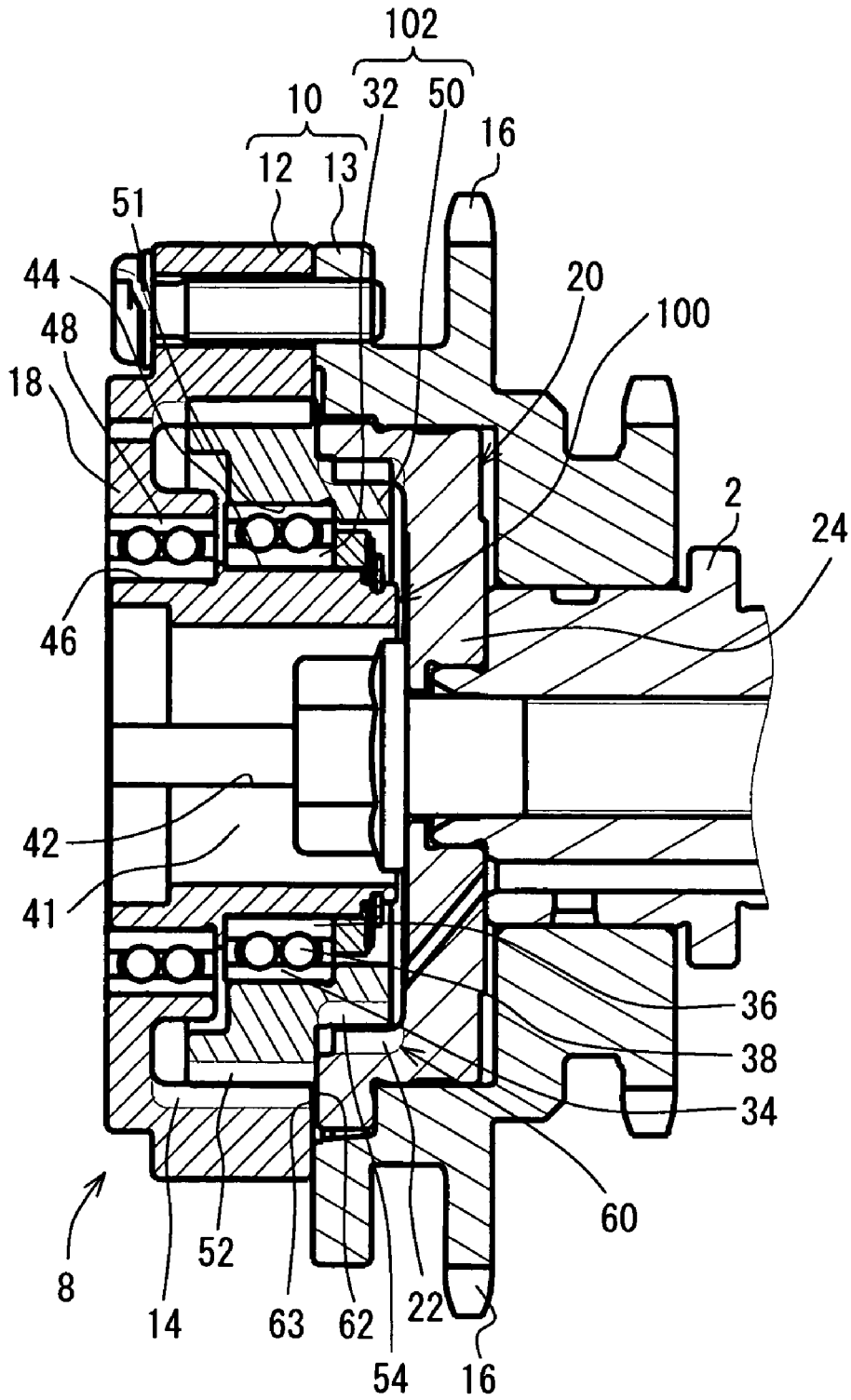
FIG. 5 is a longitudinal sectional view showing a valve timing adjusting device according to a second embodiment of the present invention.
Figure 6:
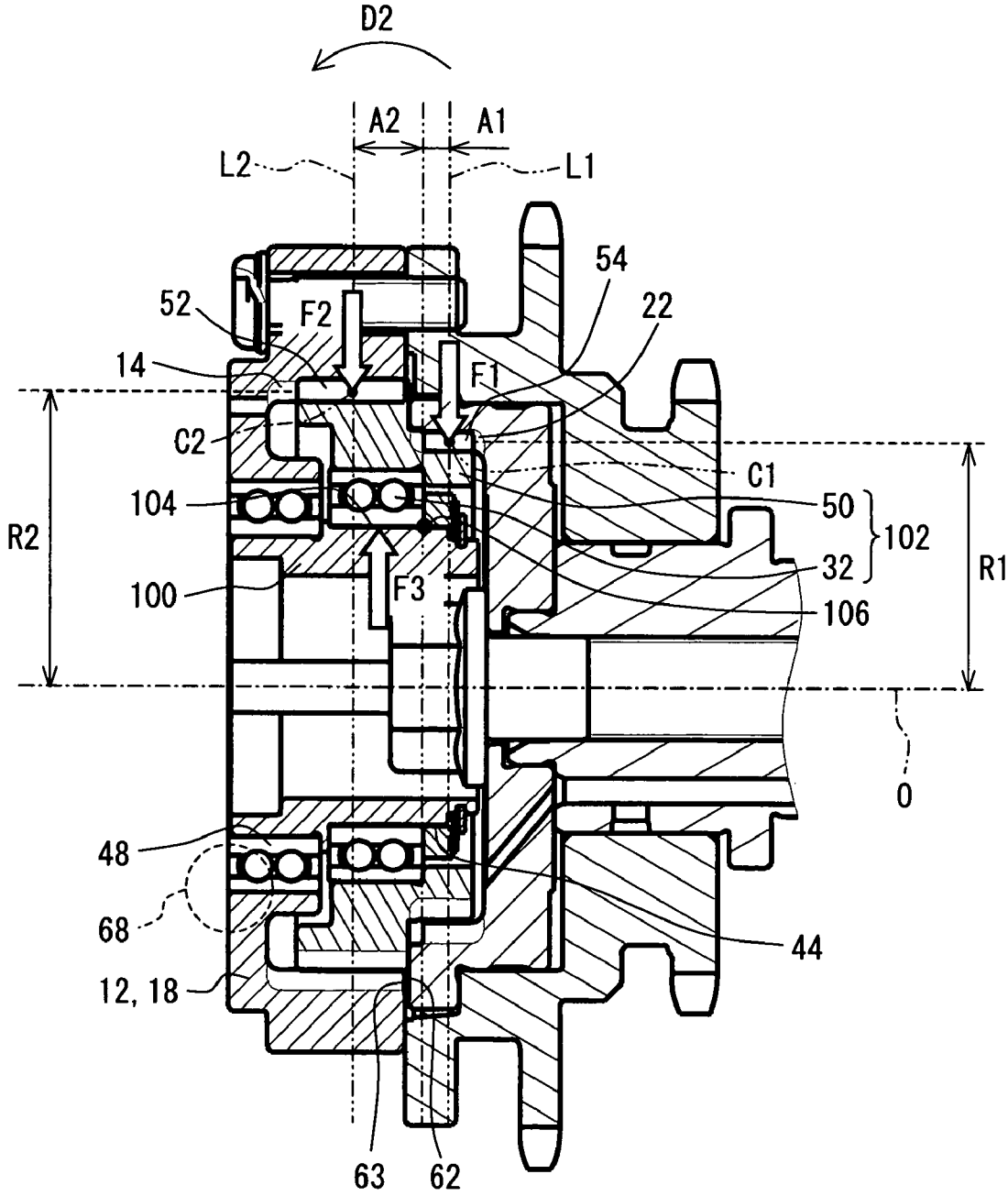
FIG. 6 is a longitudinal sectional view showing a substantial portion of the valve timing adjusting device according to the second embodiment.

Next, a valve timing adjusting device according to a second embodiment of the present invention as a modification of the first embodiment will be explained in reference to FIGS. 5 and 6. As shown in FIG. 5, in the second embodiment, a supporting mode of a planetary rotator 102 with a planetary carrier 100 is different. That is, as shown in FIG. 6, a support section 104 of the planetary carrier 100 supports the planetary rotator 102 on a projection line L2 projecting from the tooth contact center C2 of the gear sections 14, 52. On a projection line L1 projecting from the tooth contact center C1 of the gear sections 22, 54, the planetary rotator 102 is separate from and is not supported by the planetary carrier 100. The support section 104 is located on the projection line L2 side of the projection line L1. Thus, the second embodiment correctly realizes the structure in which the support section 104 of the planetary carrier 100 supporting the planetary rotator 102 is located on the inner peripheral side of the tooth contact center C2 but is separate from the inner peripheral side of the tooth contact center C1. An end 106 of the support section 104 on the driven external gear section 54 side may be located radially inside at least one of the gear sections 54, 22 or may be deviated from the range radially inside the gear sections 54, 22 unless the end 106 reaches a point radially inside the tooth contact center C1.

In the supporting mode with such the features, as shown in FIG. 6, a radial load F1 generated by the engagement between the gear sections 22, 54 acts on the planetary rotator 102 along the projection line L1 and produces first moment F1·A1 around the end 106 of the support section 104. A radial load F2 generated by the engagement between the gear sections 14, 52 acts on the planetary rotator 102 along the projection line L2 and produces second moment F2·A2 around the end 106. Therefore, in the second embodiment, in order to inhibit the inclination of the planetary rotator 102 resulting from these moments, the second moment F2·A2 corresponding to the tooth contact center C2, radially inside which the support section 104 is located, out of the contact centers C1, C2 is set larger than the first moment F1·A1 as shown by a following expression (6).

$$F1\cdot A1<F2\cdot A2 \quad (6)$$

Because of such the setting, the planetary rotator 102 tends to incline in the direction D2 of the larger second moment F2·A2 around the proximity of the end 106 of the support section 104 of the planetary carrier 100. However, the inclination is inhibited because a reaction force F3 is applied from the support section 104 to the planetary rotator 102. If the planetary rotator 102 inclines, there is a possibility that a thrust load occurs between the gear sections 14, 52 or between the gear sections 22, 54. However, the generation of the thrust load is prevented by inhibiting the inclination of the planetary rotator 102.

Also in the second embodiment, F1, F2 of the expression (6) are expressed by the expressions (3) and (4) used in the first embodiment. Therefore, it is understood that a design satisfying a following expression (7) obtained from the expressions (6), (3) and (4) can inhibit the inclination of the planetary rotator 102.

$$A1<A2\cdot(N-1)/N\cdot R1/R2\cdot\tan\theta2/\tan\theta1 \quad (7)$$

The above-described second embodiment sufficiently inhibits the inclination of the planetary rotator 102 and the generation of the thrust load between the gear sections as a result. Thus, the second embodiment can exert effects similar to those of the first embodiment. According to the second embodiment, the geared positions of the gear sections 22, 54 can be freely set unless the tooth contact center C1 overlaps with the support section 104 in the radial direction.

Figure 7:
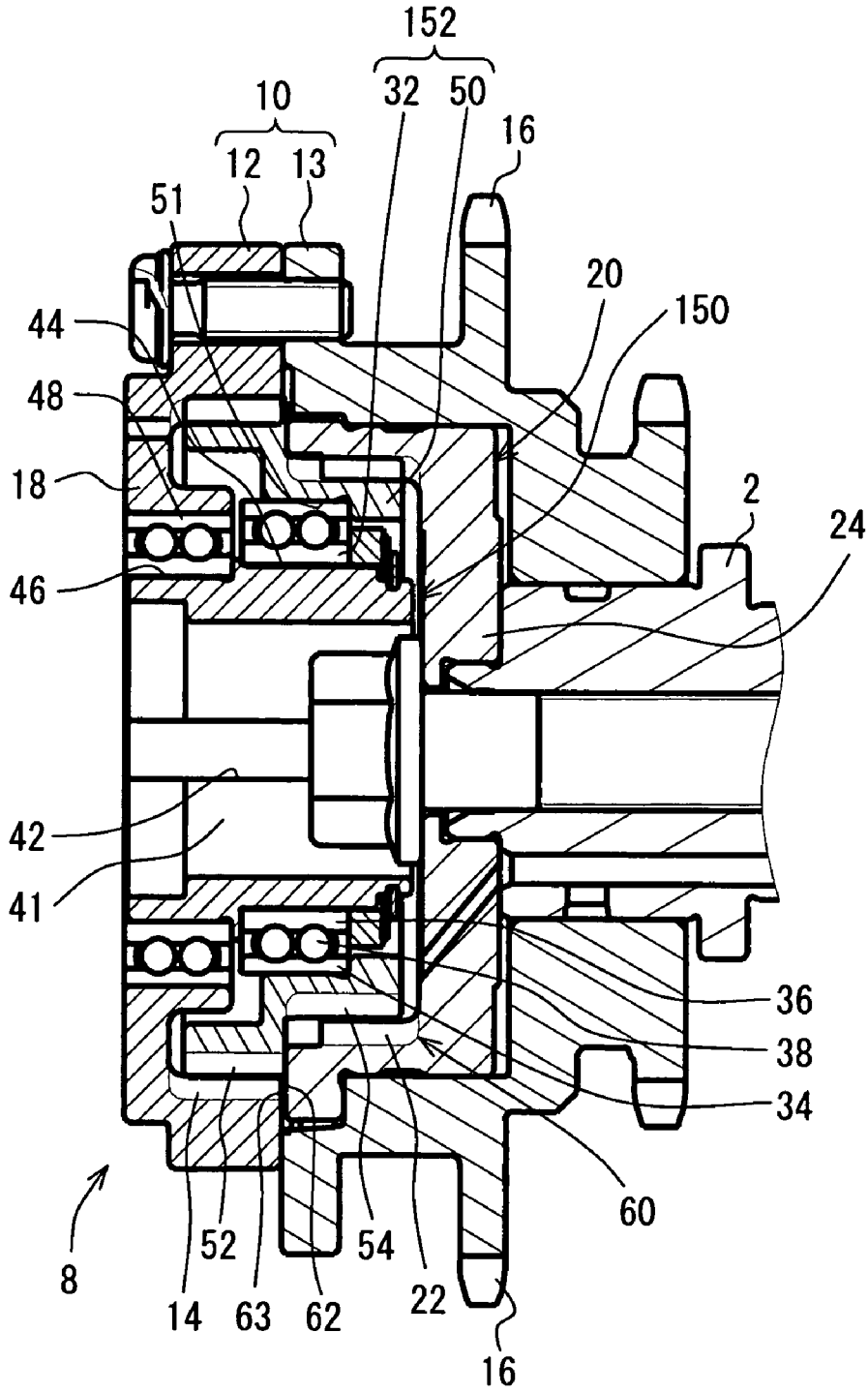
FIG. 7 is a longitudinal sectional view showing a valve timing adjusting device according to a third embodiment of the present invention.
Figure 8:
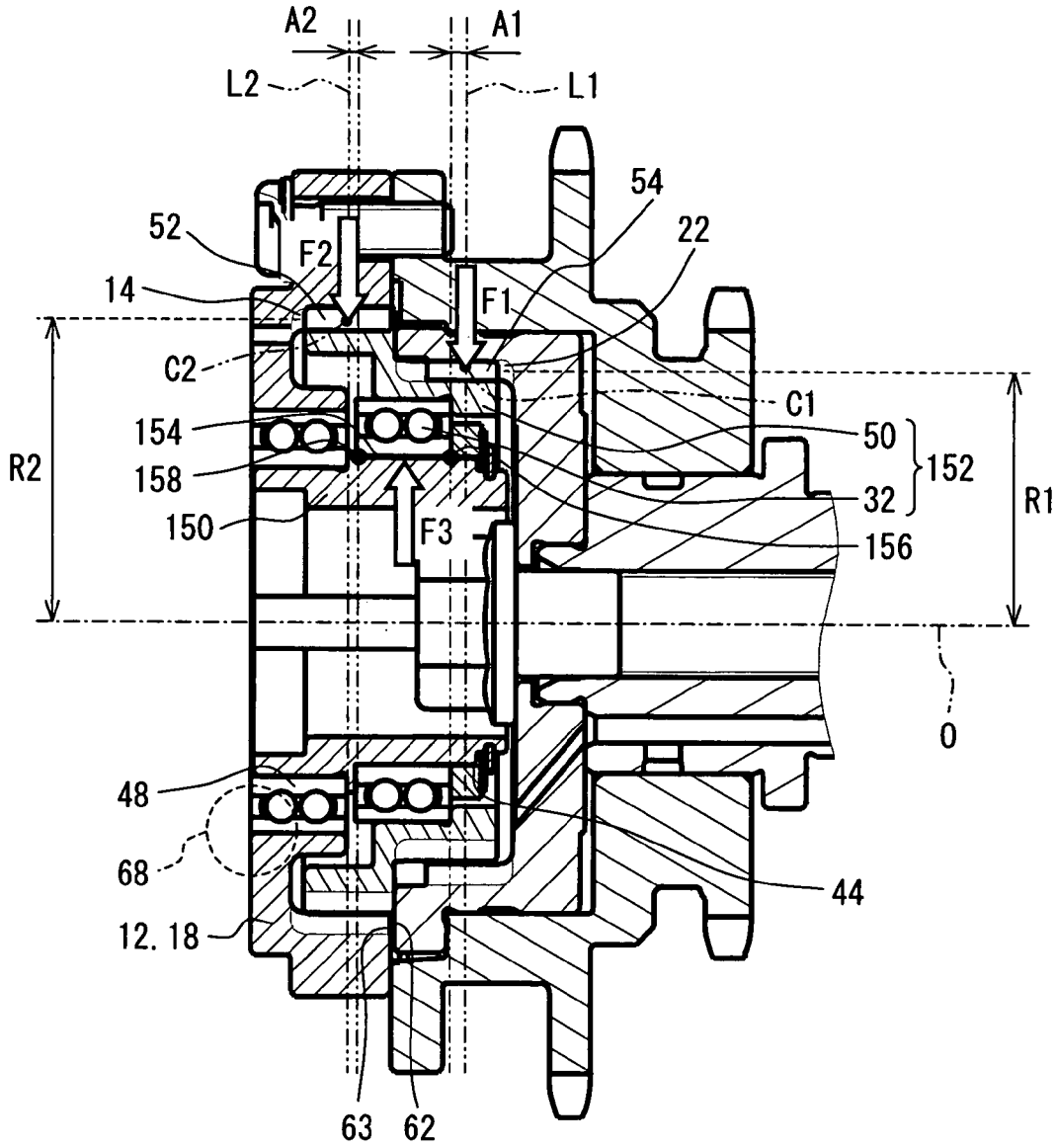
FIG. 8 is a longitudinal sectional view showing a substantial portion of the valve timing adjusting device according to the third embodiment.

Next, a valve timing adjusting device according to a third embodiment of the present invention as a modification of the first embodiment will be explained with reference to FIGS. 7 and 8. As shown in FIG. 7, in the third embodiment, a supporting mode of a planetary rotator 152 with a planetary carrier 150 is different. That is, as shown in FIG. 8, the planetary rotator 152 is separate from and is not supported by the planetary carrier 150 on a projection line L1 of the tooth contact center C1 of the gear sections 22, 54 and on a projection line L2 of the tooth contact center C2 of the gear sections 14, 52. A support section 154 of the planetary carrier 150 supports the planetary rotator 152 between the projection lines L1, L2. The support section 154 is located between the projection line L1, L2. Thus, the third embodiment correctly realizes the structure in which the support section 154 of the planetary carrier 150 supporting the planetary rotator 152 is located on the inner peripheral side between the tooth contact centers C1, C2 but is separate from the inner peripheral sides of the tooth contact centers C1, C2.

An end 156 of the support section 154 on the driven external gear section 54 side may be located radially inside at least one of the gear sections 54, 22 or may be deviated from the range radially inside the gear sections 54, 22 unless the end 156 reaches a point radially inside the tooth contact center C1. The other end 158 of the support section 154 on the driving external gear section 52 side may be located radially inside at least one of the gear sections 52, 14 or may be deviated from the range radially inside the gear sections 52, 14 unless the end 158 reaches a point radially inside the tooth contact center C2.

With the supporting mode having such the features, as shown in FIG. 8, the radial load F1 generated by the engagement between the gear sections 22, 54 acts on the planetary rotator 152 along the projection line L1 of the first tooth contact center C1 and produces first moment F1·A1 around the end 156 of the support section 154. The radial load F2 generated by the engagement between the gear sections 14, 52 acts on the planetary rotator 152 along the projection line L2 of the tooth contact center C2 and produces second moment F2·A2 around the other end 158 of the support section 154. Therefore, in the third embodiment, in order to inhibit the inclination of the planetary rotator 152 resulting from these moments, the first moment F1·A1 is set to be substantially equal to the second moment F2·A2 as shown by a following expression (8).

$$F1 \cdot A1 = F2 \cdot A2 \tag{8}$$

The planetary rotator 152 tends to incline in each moment direction in the case where the support section 154 does not exist on the inner peripheral sides of the tooth contact centers C1, C2. However, according to the moment setting shown by the expression (8), the inclination of the planetary rotator 152 can be suppressed by a reaction force F3 from the support section 154. Accordingly, the thrust load between the gear sections 22, 54 or between the gear sections 14, 52 due to the inclination of the planetary rotator 152 can be prevented.

Also in the third embodiment, F1, F2 of the expression (8) are expressed by the expressions (3) and (4) used in the first embodiment. Therefore, it is understood that a design satisfying a following expression (9) obtained from the expressions (8), (3) and (4) can inhibit the inclination of the planetary rotator 152.

$$A1 = A2(N-1)/N \cdot R1/R2 \cdot \tan\theta 2/\tan\theta 1 \tag{9}$$

The above-described third embodiment sufficiently inhibits the inclination of the planetary rotator 152 and the generation of the thrust load between the gear sections as a result. Accordingly, the third embodiment can exert effects similar to those of the first embodiment. According to the third embodiment, the geared positions between the gear sections 22, 54 and between the gear sections 14, 52 can be freely set unless the tooth contact centers C1, C2 overlap with the support section 154 in the radial direction.

Figure 9:
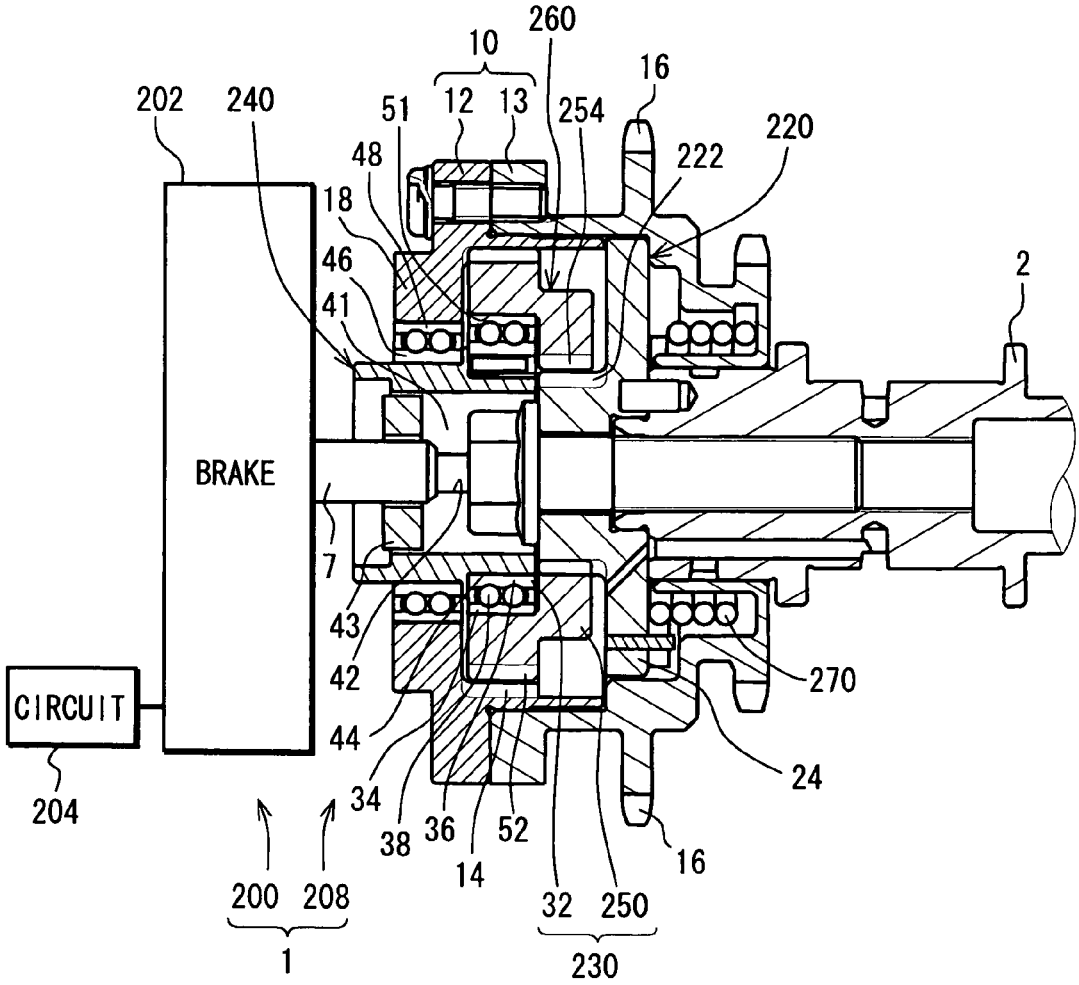
FIG. 9 is a longitudinal sectional view showing a valve timing adjusting device according to a fourth embodiment of the present invention.
Figure 10:
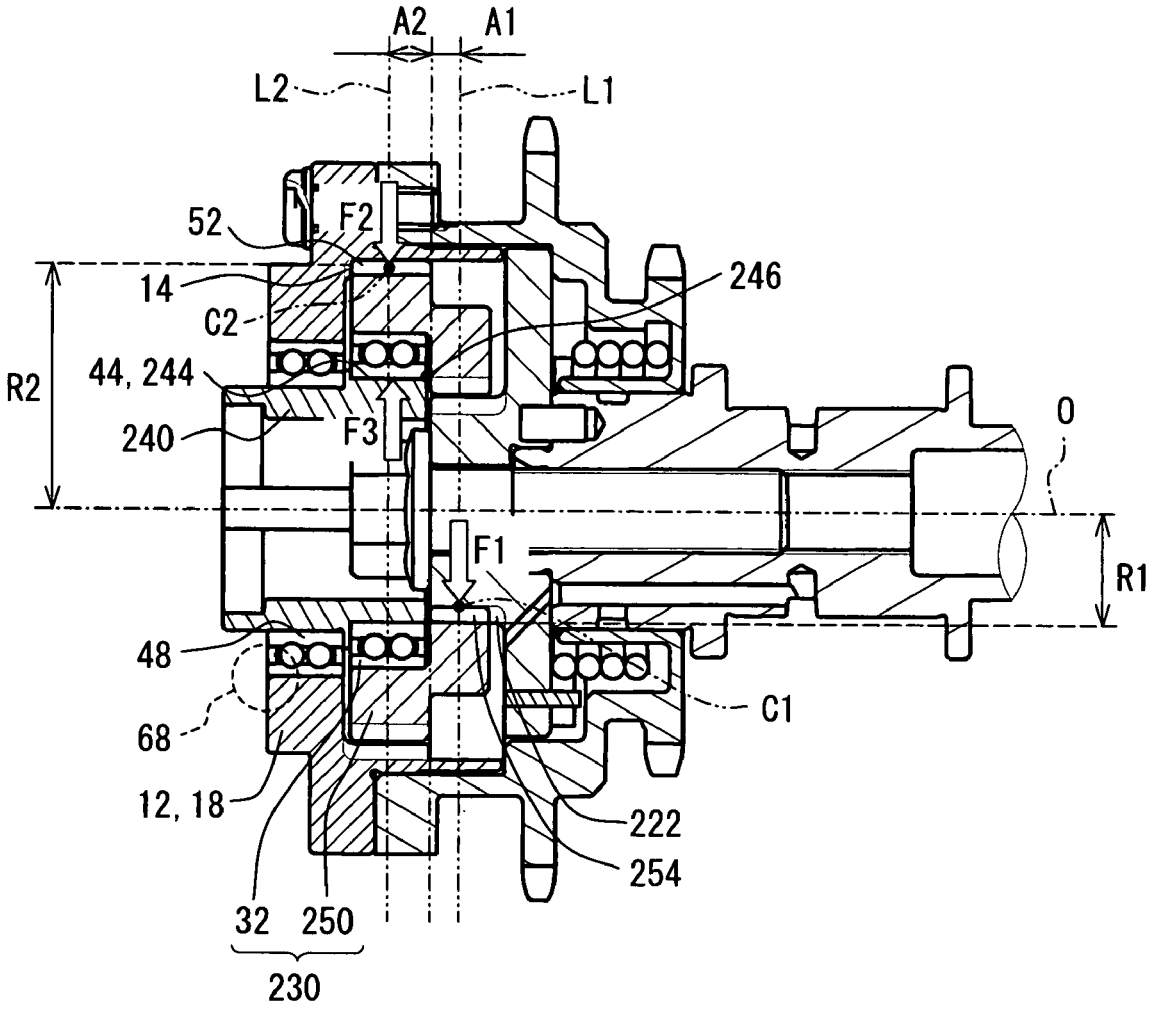
FIG. 10 is a longitudinal sectional view showing a substantial portion of the valve timing adjusting device according to the fourth embodiment.
Figure 11:
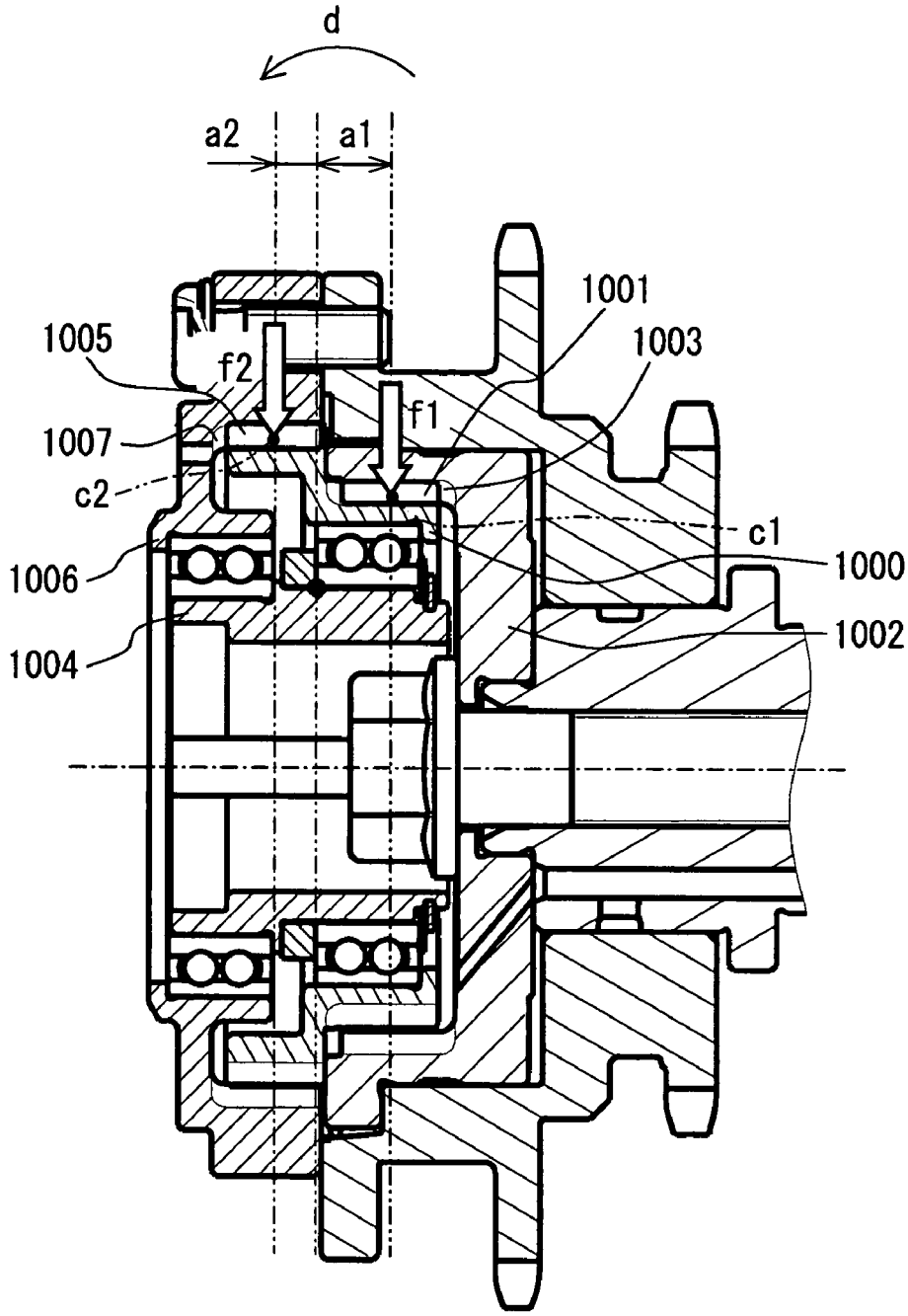
FIG. 11 RELATED ART
FIG. 11 is a longitudinal sectional view showing a valve timing adjusting device of a related art.

Next, a valve timing adjusting device according to a fourth embodiment of the present invention as a modification of the second embodiment will be explained with reference to FIGS. 9 and 10. As shown in FIG. 9, in the fourth embodiment, a torque generating system 200 has an electric brake 202 instead of the electric motor 5. The electric brake 202 is an electromagnetic brake or a fluid brake, for example. The electric brake 202 holds or changes braking torque applied to the rotary shaft 7 in accordance with energization from an energization control circuit 204.

A driven rotator 220 according to the fourth embodiment has a driven external gear section 222 at a position deviated from the driving internal gear section 14 in the axial direction instead of the driven internal gear section 22. A planetary gear 250 of a planetary rotator 230 supported by a planetary carrier 240 has a driven internal gear section 254 at a position deviated from the driving external gear section 52 in the axial direction instead of the driven external gear section 54. The driven internal gear section 254 is located radially outside the driven external gear section 222 and geared with the gear section 222. In the present embodiment, both axial end faces of the gear sections 52, 254, are separate from the rotators 10, 220.

A biasing member 270 is added to a planetary mechanism section 260 of the fourth embodiment made by engaging the gear section 254, 222. The biasing member 270 consists of a torsion coil spring and is arranged radially inside the sprocket 13 concentrically with the sprocket 13. An end of the biasing member 270 is linked with the sprocket 13 and the other end of the biasing member 270 is linked with the linked part 24. The biasing member 270 biases the driven rotator 220 to the retardation side Y with respect to the driving rotator 10. Therefore, a phase adjusting mechanism 208 having the planetary mechanism section 260 adjusts the engine phase in accordance with the torque inputted from the torque generating system 200, biasing torque generated by the biasing member 270, and the average torque Ta of the fluctuation torque transmitted from the camshaft 2.

In the thus-structured fourth embodiment, the supporting mode of the planetary rotator 230 with the planetary carrier 240 and the setting of the moment according to the supporting mode are realized similarly to the second embodiment. That is, as shown in FIG. 10, a support section 244 of the planetary carrier 240 supports the planetary rotator 230 on the projection line L2 radially inside the tooth contact center C2 of the gear sections 14, 52, and the support section 244 is deviated from the projection line L1 radially inside the tooth contact center C1 of the gear sections 222, 254. First moment F1·A1 generated by a radial load F1, which acts between the gear sections 222, 254, around an end 246 of the support section 244 on the driven internal gear section 254 side and second moment F2·A2 generated by a radial load F2, which acts between the gear sections 14, 52, around the end 246 are set according to the expression (6) used in the second embodiment.

Thus, the fourth embodiment inhibits the inclination of the planetary rotator 230 and the generation of the thrust load between the gear sections as a result. Accordingly, ensuring of the durability, the reduction of the axial physique, the reduction of the cost and the like can be realized at the same time. As shown in FIG. 10, in the fourth embodiment, the support section 244 is formed by the entire body of the eccentric portion 44 of the planetary carrier 240.

The above-described embodiments may be modified as follows, for example.

In the first to fourth embodiments, the rotator 10 may be rotated with the camshaft 2 in an interlocked manner and the rotator 20 (220) may be rotated with the crankshaft in an interlocked manner.

In the first to fourth embodiments, the planetary gear 50 (250) may be supported directly by the planetary carrier 40 (100, 150, 240) without providing the bearing 32. Alternatively, the planetary gear 50 (250) may be supported by the bearing 32 integrated with the planetary carrier 40 (100, 150, 240) by press-fitting the inner ring 36 of the bearing 32 to the outer periphery of the planetary carrier 40 (100, 150, 240) and by fitting the outer ring 34 of the bearing 32 to the inner periphery of the planetary gear 50 (250).

In the first to fourth embodiments, a hydraulic motor or the like may be used in place for the electric motor 5 or the electric brake 202 as a device for generating the torque applied to the phase adjusting mechanism 8 (208).

In the first to third embodiments, as in the fourth embodiment, at least one of the external gear sections 52, 54 and at least corresponding one of the internal gear sections 14, 22 may be replaced with an internal gear section and an external gear section respectively.

In the first to third embodiments, as in the fourth embodiment, the driven rotator 20 may be separate from the axial end face 62 of the driving external gear section 52. In the first to third embodiments, the driving rotator 10, may be in contact with the axial end face of the driving external gear section 52 or the rotators 10, 20 may be in contact with the axial end faces of the driven external gear section 54. In the fourth embodiment, the rotators 10, 220 may be in contact with the axial end faces of the gear sections 52, 254.

The present invention is applicable also to a device that adjusts valve timing of an exhaust valve or a device that adjusts valve timing of both of the intake valve and the exhaust valve in addition to the device that adjusts the valve timing of the intake valve as in the first to fourth embodiments.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A valve timing adjusting device of an internal combustion engine for adjusting valve timing of at least one of an intake valve and an exhaust valve, which are opened and closed by a camshaft through torque transmission from a crankshaft, the valve timing adjusting device comprising:

a first rotator that has a first gear section and that rotates with the camshaft in an interlocked manner;

a second rotator that has a second gear section and that rotates with the crankshaft in an interlocked manner;

a planetary rotator that has a third gear section and a fourth gear section and changes a relative phase between the first rotator and the second rotator through sun-and-planet motion performed integrally by the third gear section and the fourth gear section while the third gear section and the fourth gear section are geared with the first gear section and the second gear section respectively; and a planetary carrier that has a support section for supporting the planetary rotator such that the sun-and-planet motion can be performed, wherein the support section is located on an inner peripheral side of a first center, which is a tooth contact center between the first gear section and the third gear section, and is separate from an inner peripheral side of a second center, which is a tooth contact center between the second gear section and the fourth gear section, and the valve timing adjusting device is structured such that first moment generated in the planetary rotator by a radial load applied to the third gear section by the first gear section is larger than second moment generated in the planetary rotator by a radial load applied to the fourth gear section by the second gear section.

2. The valve timing adjusting device as in claim 1, wherein the support section is located on a first projection line, which is a projection line projected from the first center in a radial direction, on a first projection line side of a second projection line, which is a projection line projected from the second center in the radial direction.

3. The valve timing adjusting device as in claim 1, wherein the first rotator or the second rotator contacts at least one of axial end faces of the third gear section and the fourth gear section such that relative rotation occurs between the first rotator or the second rotator and the one of the axial end faces of the third gear section and the fourth gear section.

4. The valve timing adjusting device as in claim 1, wherein the planetary rotator has a planetary gear that provides the third gear section and the fourth gear section and a bearing having an outer ring fixed to an inner peripheral side of the planetary gear and an inner ring fitted to an outer peripheral side of the planetary carrier.

5. A valve timing adjusting device of an internal combustion engine for adjusting valve timing of at least one of an intake valve and an exhaust valve, which are opened and closed by a camshaft through torque transmission from a crankshaft, the valve timing adjusting device comprising:

a first rotator that has a first gear section and that rotates with the camshaft in an interlocked manner;

a second rotator that has a second gear section and that rotates with the crankshaft in an interlocked manner;

a planetary rotator that has a third gear section and a fourth gear section and changes a relative phase between the first rotator and the second rotator through sun-and-planet motion performed integrally by the third gear section and the fourth gear section while the third gear section and the fourth gear section are geared with the first gear section and the second gear section respectively; and a planetary carrier that has a support section for supporting the planetary rotator such that the sun-and-planet motion can be performed, wherein the support section is separate from an inner peripheral side of a first center, which is a tooth contact center between the first gear section and the third gear section, and is located on an inner peripheral side of a second center, which is a tooth contact center between the second gear section and the fourth gear section, and the valve timing adjusting device is structured such that second moment generated in the planetary rotator by a radial load applied to the fourth gear section by the second gear section is larger than first moment generated in the planetary rotator by a radial load applied to the third gear section by the first gear section.

6. The valve timing adjusting device as in claim 5, wherein the support section is located on a second projection line, which is a projection line projected from the second center in a radial direction, on a second projection line side of a first projection line, which is a projection line projected from the first center in the radial direction.

7. The valve timing adjusting device as in claim 5, wherein the first rotator or the second rotator contacts at least one of axial end faces of the third gear section and the fourth gear section such that relative rotation occurs between the first rotator or the second rotator and the one of the axial end faces of the third gear section and the fourth gear section.

8. The valve timing adjusting device as in claim 5, wherein the planetary rotator has a planetary gear that provides the third gear section and the fourth gear section and a bearing having an outer ring fixed to an inner peripheral side of the planetary gear and an inner ring fitted to an outer peripheral side of the planetary carrier.

9. A valve timing adjusting device of an internal combustion engine for adjusting valve timing of at least one of an intake valve and an exhaust valve, which are opened and closed by a camshaft through torque transmission from a crankshaft, the valve timing adjusting device comprising:

a first rotator that has a first gear section and that rotates with the camshaft in an interlocked manner;

a second rotator that has a second gear section and that rotates with the crankshaft in an interlocked manner;

a planetary rotator that has a third gear section and a fourth gear section and changes a relative phase between the first rotator and the second rotator through sun-and-planet motion performed integrally by the third gear section and the fourth gear section while the third gear section and the fourth gear section are geared with the first gear section and the second gear section respectively; and a planetary carrier that has a support section for supporting the planetary rotator such that the sun-and-planet motion can be performed, wherein the support section is separate from inner peripheral sides of a first center, which is a tooth contact center between the first gear section and the third gear section, and a second center, which is a tooth contact center between the second gear section and the fourth gear section, and is located between the inner peripheral sides of the first center and the second center, and the valve timing adjusting device is structured such that first moment generated in the planetary rotator by a radial load applied to the third gear section by the first gear section substantially coincides with second moment generated in the planetary rotator by a radial load applied to the fourth gear section by the second gear section.

10. The valve timing adjusting device as in claim 9, wherein the support section is located between a first projection line, which is a projection line projected from the first center in a radial direction, and a second projection line, which is a projection line projected from the second center in the radial direction.

11. The valve timing adjusting device as in claim 9, wherein the first rotator or the second rotator contacts at least one of axial end faces of the third gear section and the fourth gear section such that relative rotation occurs between the first rotator or the second rotator and the one of the axial end faces of the third gear section and the fourth gear section.

12. The valve timing adjusting device as in claim 9, wherein the planetary rotator has a planetary gear that provides the third gear section and the fourth gear section and a bearing having an outer ring fixed to an inner peripheral side of the planetary gear and an inner ring fitted to an outer peripheral side of the planetary carrier.

* * * * *